United States Patent [19]

Pongracz

[11] 4,222,533

[45] Sep. 16, 1980

[54] PACKAGING MATERIAL FEEDING DEVICE FOR A PACKAGING MACHINE

[75] Inventor: Endre Pongracz, Ecublens, Switzerland

[73] Assignee: Societe Anonyme des Plieuses Automatiques (SAPAL), Switzerland

[21] Appl. No.: 70,681

[22] Filed: Aug. 29, 1979

[30] Foreign Application Priority Data

Sep. 5, 1978 [CH] Switzerland ..... 9298/78

[51] Int. Cl.[3] ..... B65H 19/14

[52] U.S. Cl. ..... 242/58.3; 156/502

[58] Field of Search ..... 242/58.3, 58.1, 58.2, 242/58.4, 58.5; 156/502, 504

[56] References Cited

U.S. PATENT DOCUMENTS

| | | | |
|---|---|---|---|
| 3,024,157 | 3/1962 | Beerli | 242/58.1 |
| 3,089,661 | 5/1963 | Phillips | 242/58.3 X |
| 3,194,508 | 7/1965 | Netze | 242/58.3 |
| 3,730,811 | 5/1973 | Wendt | 242/58.3 |
| 3,974,490 | 8/1976 | Mori | 242/58.1 |
| 4,113,197 | 9/1978 | Harrington | 242/58.1 |

*Primary Examiner*—Edward J. McCarthy

*Attorney, Agent, or Firm*—Lerner, David, Littenberg & Samuel

[57] ABSTRACT

The present invention relates to a packaging material feeding device on a packaging machine with two winders. This system includes two driving servomotors 4, 34, winders 1, 31, a driving mechanism 24, 25 of the packaging material in the form of a strip, two coding devices 54, 56, and sensing devices 55, 57 which sense a signal corresponding to the instantaneous diameter of the activated packaging material reel and, in response thereto, supply a control signal for controlling the driving speed of these winders. The system also includes a press 17, 21 to automatically match the end of the strip of packaging material on the reel being unrolled to the beginning of the strip on the following reel.

10 Claims, 2 Drawing Figures

PACKAGING MATERIAL FEEDING DEVICE FOR A PACKAGING MACHINE

FIELD OF THE INVENTION

The present invention deals with a packaging material feeding device for a packaging machine, including two winders, each bearing a reel of the packaging material in strip form, these winders being alternatively activated in order to ensure a continuous supply for the machine.

BACKGROUND OF THE INVENTION

In order to increase the yield of packaging machines at high speed, it is customary to use two winders. Such a system makes it possible to reload the machine without slowing it down or stopping it by replacing an empty reel with a full reel while another reel is being unrolled and to automatically pass to the new reel when the preceding reel is empty. In the known systems, the driving of the winders is exclusively accomplished by the mere traction of the packaging material driven by two driving rollers. Since the reels of packaging material are relatively heavy, the winder and reel system offers a relatively high inertia at the start. The tension applied on the packaging material at the start, or each time the machine starts rolling in the case of a machine operated intermittently, is very high, and this prevents using a thin packaging material. In particular, the use of aluminum film with a 9 to 10 $\mu$ thickness, of which the tensile strength is insufficient to be subjected to such tensions, is impossible with such machines.

The present invention intends to overcome this drawback by designing a feeding system for a packaging machine, with a packaging material in the form of very thin strips, this supply being accomplished in a semiautomatic manner with a maximum of accuracy.

SUMMARY OF THE INVENTION

To accomplish this, the device according to the present invention includes two driving servomotors to independently drive both winders, a driving device for the packaging material, two coding and sensing devices to supply a control signal for adjusting the driving speed of both winders on the basis of the driving speed of the packaging material and the instantaneous diameter of the activated reel, two ends of strip sensing devices, and a mechanism to automatically match the end of strip of the packaging material on the activated reel with the beginning of the strip of the material on the following reel. This mechanism includes a press to apply both strip ends against the other, and a driving device for this press designed so as to receive an end of strip sensing signal from one of the ends of strip sensors and to control the press after a given delay according to the driving speed of the packaging material.

BRIEF DESCRIPTION OF THE DRAWINGS

The present invention will be better understood if we refer to the description of a construction example and to the attached drawing, in which.

DETAILED DISCUSSION OF PREFERRED EMBODIMENT OF THE INVENTION

Figure 1:
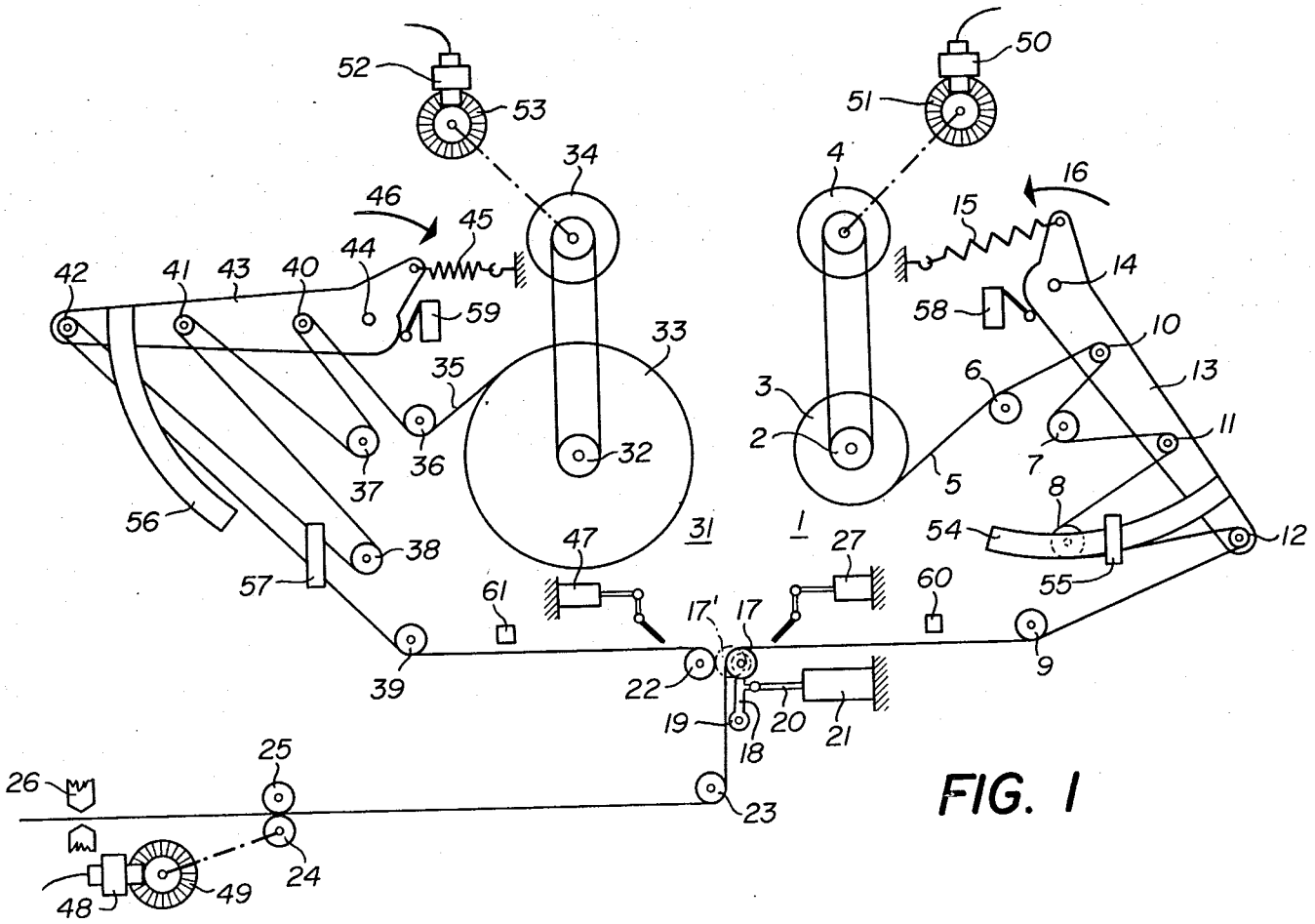
FIG. 1 represents a schematic view of the supply device according to the invention.

The device such as represented in FIG. 1 includes a winder 1, of which the spindle 2 carries a reel 3 of packaging material, shown partly unrolled, for instance, thin aluminum with a 9 to 10$\mu$ thickness. The spindle 2 of the winder is driven by a driving motor 4 having excellent acceleration and braking characteristics. The packaging material 5 in the form of a strip makes several loops while alternately passing over four rollers or cam rolls with stationary axes 6, 7, 8, and 9, and three rollers or cam rolls 10, 11, and 12, of which the axes are mounted on an arm 13 pivoting about a stationary axis 14.

As it will be explained herein, the loops are of various dimensions according to the position occupied on the arm 13, position subordinate to the tension applied by the aluminum film, and the diameter of the reel mounted on the winder. On one of the extremities of the arm 14 is attached one end of a traction spring 15 which tends to make the arm 14 tilt in the direction of the arrow 16 around the pivoting axis 14. After the packaging material passes the stationary axis roller 9, it passes around a roller 17 mounted on a support 18 rotating about a stationary axis 19. This support is integral with a rod 20 which can be moved between two extreme positions by the action of an electromagnet 21. In the position represented by a solid line, the roller 17 is behind, while in its position 17', shown by a dotted line, it is in front and engages a stationary axis roller 22. After the roller 17, the packaging material passes around a last roller 23 which changes its direction before it is finally pinched between two rollers 24, 25 with a continuous or intermittent drive. Then it passes in front of a cutting device 26 shown in a schematic manner. An anti-return device 27 is mounted about the packaging material strip upstream of the roller 17.

The device of FIG. 1 includes a second group of elements similar to those which have just been described. This group includes a winder 31 having a spindle 32 which carries a packaging material reel 33, shown still full. The spindle of the winder is driven by a driving motor 34 identical to the motor 4. As previously, the packaging material, in the form of a very thin aluminum film 35, unrolls through a given number of loops. These are formed by passing alternately about stationary axes rollers 36, 37, 38, and 39 and about rollers 40, 41, and 42, of which the axes are mounted on an arm 43 rotating around a stationary axis 44. The arm 43 is maintained on one end by a spring 45 in the direction of the arrow 46, and on the other end by the traction applied on the film 35 when it is pressed between the driven rollers 24, 25. As previously, an anti-return device 47 is mounted above the film, and in this case, it is located downstream of the roller 22.

The winders described above also include a first incremental impulse generator 48, of which the reference disk 49 is driven in synchronism with the driving rollers 24, 25, a second incremental impulse generator 50, of which the reference disk 51 is driven in synchronism with the spindle 2 of the winder 1 by means of the driving motor 4, and a third incremental impulse generator 52, of which the reference disk 53 is driven by means of the motor 34 in synchronism with the spindle 32 of the winder 31.

In addition, the arm 13 carries an arched section 54, including a series of coding bands, designed to detect the position of arm 13 by means of a sensor 55. This arched section carries, for instance, three superposed series of black or white bands. Each series includes six bands in the example shown. In all, 18 bands are employed which correspond to six three-bit codes. The part of the section which does not carry any band also corresponds to a three-bit code (three black bands), and the area fictitiously extending the section beyond the coding bands corresponds to an eighth three-bit code (three white bands). Of course, the distribution of the bands and their number may be of any kind according to the information which it is desired to code and decode. In a similar manner, the arm 43 carries an arched section 56 identical to the section 54 and designed to make it possible to detect the position of arm 43 by means of a sensor 57. Two switches 58, 59, arranged in such a manner as to be switched on or off according to the position of the arms 13, 14, respectively, control the starting or stopping of the driving motors 4, 34.

Let us first assume, as is represented in FIG. 1, that the packaging material feeding device is fed by the partly unroller winder 1. The spindle 2 is activated by the driving motor 4 by means, for instance, of a notched belt. The packaging material 5 is driven toward the cutting mechanism 26 by the two driving rollers 24, 25. In known systems, the packaging material is drawn forward by the driving rollers, the winder unrolling only by means of the traction applied on the strip of packaging material. This principle cannot be used with an aluminum film 9 to 10$\mu$ thick, since the traction which would have to be applied on the material to unroll the winder would be higher than its mechanical strength. In the present invention, the traction power applied by the driving rollers applies a tension to the packaging material which has a tendency to make the arm 13 rotate in the direction opposite to the arrow 16, and this action is counterbalanced by the tension of the spring 15.

Figure 2:
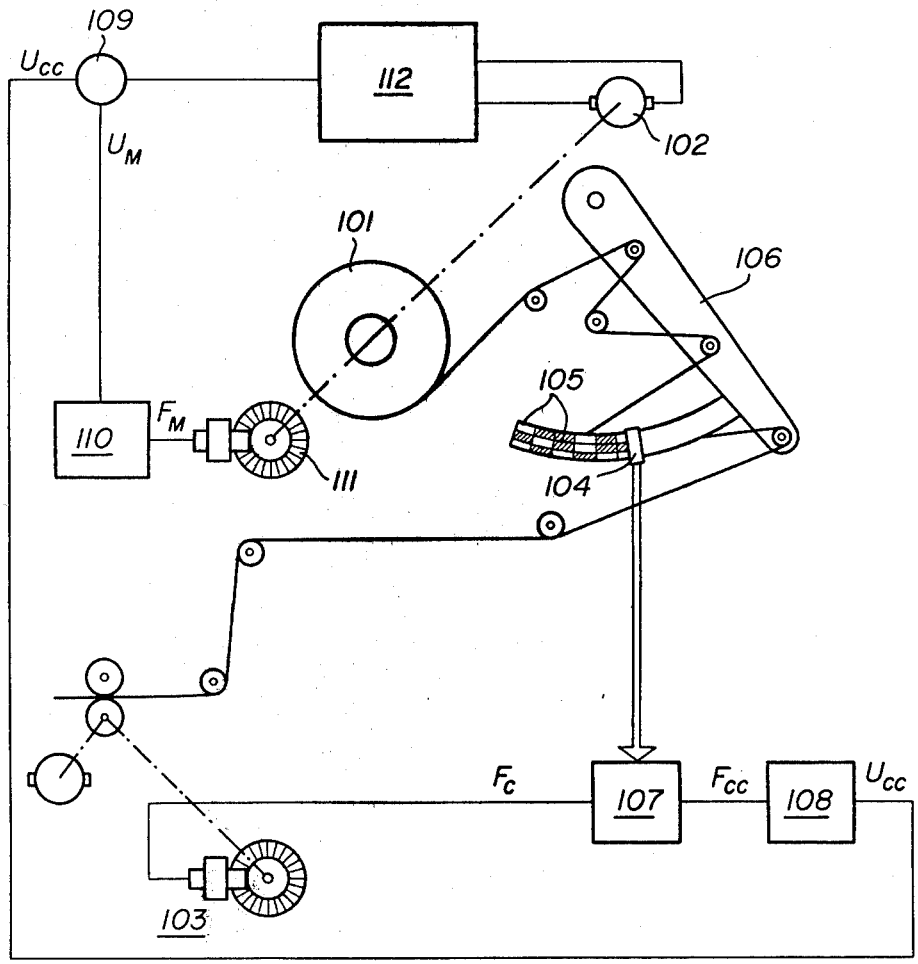
FIG. 2 shows in greater details the control circuit for the device on FIG. 1.

Referring to FIG. 2, the driving motor 102 of the winder spindle 101 rotates at a speed which is controlled by a control signal, called the instruction signal, proportional to the frequency of the pulses generated by the impulse generator 103. The frequency of the speed instruction signal is altered during the operation of the device according to the code read by the sensor 104 on the arched section bearing the coding bands 105. To a given diameter of the reel of packaging material being used at the moment corresponds a position of the swinging arm 106, on which is mounted the arched section bearing the coding bands 105. In general, this position is not stationary and oscillates between two coding bands. As the diameter of the reel decreases from its maximum diameter toward its minimum diameter, the swinging arms move clockwise.

The frequency of the speed instruction signal $F_c$, determined by the impulse generator 103, is fed into a multiplier 107 which multiplies this frequency by a coefficient K which is a digital factor subordinate to the code detected by the sensor 104. The output signal $F_{cc}$, referred to as modified speed instruction frequency, of the multiplier 107 is transmitted to a frequency-voltage converter 108 which transmits a voltage $U_{cc}$, referred to as modified speed instruction voltage, to a comparator 109. This comparator also receives a voltage $U_M$, called measured speed voltage. Voltage $U_M$ is transmitted by a frequency-voltage converter 110, of which the input signal is a measured frequency signal $F_M$, supplied by a digital tachometer dynamo 111 rotating in synchronism with the driving motor 102. The comparator 109 supplies an output signal to a four-dial regulator 112 which then adjusts the speed of the driving motor 102 by means of a conventional closed loop adjusting circuit (not shown).

As mentioned above, in reference to FIG. 1, when the reel 3 carried by the spindle 2 becomes empty, the end of the packaging material is torn off and is detected by an end of strip sensor 60 which transmits, after a programmed delay, which is itself a function of the speed of the machine, an end of strip signal to the electromagnet 21. This energizing pulse causes rod 20 to move roller 17 to its position 17' and engaging the roller 22. Roller 17 returns to its original position at the end of the energizing pulse. Before this occurs, the end of the strip 35 of the reel 33 is manually brought onto the roller 22 and is equipped on its upper surface with a double-face adhesive strip, so that the pressure of the roller 17 against the roller 22 results in the end of the strip from reel 3 sticking to the beginning of the strip from the reel 33.

Simultaneously, the beginning of the signal activating the electromagnet 21 also generates the switching cycle of the motor 4 to the motor 34 and of the group of satellite elements of the winder 1 to the satellite elements of the winder 31. During this switching, the motor 34 is stopped. As a result of the tension applied to the packaging material driven by the rollers 24, 25, the arm 43 moves counterclockwise and activates the safety switch 59. This switch turns on the motor 34, the arm 43 returning to a balanced position which is a function of the temporary diameter of the reel 33. As previously, at the end of the unrolling, a sensor 61 supplies an end of strip signal which activates in particular the electromagnet 21 in order to stick the end of the strip 35 against the new strip 5 which, in the meanwhile, has been placed on the winder 1.

The present invention makes possible to continuously feed in an accurate and efficient manner a packaging machine with a very thin packaging material. As a result of the electronic sensor for sensing the end of a strip and to the electromechanical control of sticking the end of a strip to the beginning of the following strip, it is possible to obtain at each changeover of reel a section of packaging material with a double thickness of constant length, this length being as small as possible.

A latitude of modification, change, and substitution is intended in the foregoing disclosure, and in some instances, some features of the invention will be employed without a corresponding use of other features. Accordingly, it is appropriate that the appended claims be construed broadly in a manner consistent with the spirit and scope of the invention herein.

What is claimed is:

1. A device for feeding package material to a packaging machine comprising:

at least first and second winders for receiving first and second reels of packaging material in strip form, respectively;

winder driving means for alternately driving said winders independently of each other so that one reel is feeding packaging material while the other reel can be reloaded;

packaging material driving means for driving the packaging material to said packaging machine;

sensing means for sensing the speed of said packaging material and the instantaneous diameter of said real which is feeding;

control signal supply means for supplying a control signal to said winder driving means for adjusting the driving speed of said winders in response to said sensing means;

first and second ends of strip sensing devices for sensing the end of the packaging material from said reel which is feeding and for supplying an end of strip control signal;

attaching means for attaching the end of the packaging material from said reel which is feeding to the beginning of the packaging material from said other reel; and actuating means for actuating said attaching means in response to said end of strip control signal.

2. A device according to claim 1, wherein said winder driving means includes two separate driving servomotors for independently driving said winders.

3. A device according to claim 1, wherein said means for driving said packaging material includes a pair of driving rollers for pulling said strip of packaging material from said reel which is feeding.

4. A device according to claim 1, wherein said sensing means includes at least one movable arm, actuated at one end thereof by said packaging material and attached at the other end thereof to biasing means to balance the position of said arm.

5. A device according to claim 4, wherein said sensing means further includes coding means attached to said arm and a sensor to sense said coding means.

6. A device according to claim 3, wherein said means for supplying a control signal includes an impulse generator rotating in synchronism with said winders for supplying said adjust signal to control the speed of said driving means to control the speed of said reel which is feeding.

7. A device according to claim 1, wherein said attaching means includes pressing means for attaching the strips of packaging material from said first and second reels, and said actuating means includes an electromagnet for actuating said pressing means.

8. A device according to claim 7, wherein said pressing means includes a pair of relatively movable rollers for pressing the strips of packaging material together.

9. A device according to claim 5, further including electronic control means connected to said sensing means for adjusting the speed of said reel which is feeding.

10. A device according to claim 9, wherein said electronic control means includes a frequency multiplier, a frequency-voltage converter, and a comparator.

* * * * *

UNITED STATES PATENT AND TRADEMARK OFFICE

CERTIFICATE OF CORRECTION

PATENT NO. : 4,222,533

DATED : September 16, 1980

INVENTOR(S) : Endre Pongracz

It is certified that error appears in the above-identified patent and that said Letters Patent are hereby corrected as shown below:

Column 6, line 9, "said adjust signal to control the speed" should read --said control signal to adjust the speed--.

Signed and Sealed this

*Sixteenth* Day of *December 1980*

[SEAL]

*Attest:*

SIDNEY A. DIAMOND

*Attesting Officer*

*Commissioner of Patents and Trademarks*